United States Patent [19]

Pennington

[11] 4,033,419

[45] July 5, 1977

[54] VIBRATOR AND PUSHING APPARATUS FOR DRIVING METAL PINS IN ROCK FACES IN MINES

[75] Inventor: James R. Pennington, Basking Ridge, N.J.

[73] Assignee: Allied Chemical Corporation, Morris Township, N.J.

[22] Filed: Apr. 4, 1973

[21] Appl. No.: 347,936

[52] U.S. Cl. ..... 173/34; 61/45 B; 173/49; 173/160; 175/19; 227/130

[51] Int. Cl.[2] ..... E21D 20/00

[58] Field of Search ..... 61/45 B; 173/34, 36, 173/49, 160, 112, 52; 175/19, 55, 56; 227/130, 131, 147

[56] References Cited

UNITED STATES PATENTS

| | | | |
|---|---|---|---|
| 3,008,528 | 11/1961 | Berthet et al. | 173/49 |
| 3,431,988 | 3/1969 | Bodine | 175/56 |
| 3,595,325 | 7/1971 | Libby et al. | 175/56 X |
| 3,597,929 | 8/1971 | Bodine | 173/52 X |
| 3,721,094 | 3/1973 | Elders et al. | 173/34 X |
| 3,819,101 | 6/1974 | Elders et al. | 227/130 |

*Primary Examiner*—Ernest R. Purser
*Attorney, Agent, or Firm*—Gerard P. Rooney

[57] ABSTRACT

Method and apparatus for driving metal pins into a rock face in an underground mine to strengthen rock surfaces such as stratified overburden, or rock ribs, against failure. A cylinder containing a pin with its head resting on a driven member, and having lateral support within the apparatus, is positioned against the rock face to be pinned. The pin is then driven into the rock by a combination of pressure and vibration at sonic frequencies applied longitudinally to the pin to thus strengthen the rock face against collapse.

8 Claims, 6 Drawing Figures

VIBRATOR AND PUSHING APPARATUS FOR DRIVING METAL PINS IN ROCK FACES IN MINES

BACKGROUND OF THE INVENTION

Field of the Invention

This invention relates to a method and apparatus for driving pins into rock faces in mines to prevent their collapse.

II. Description of the Prior Art

The collapse of sections of mine roof has long been regarded as one of the greatest hazards of undergound mining, and various methods of supporting the overburden in mines have been tried.

The roof of a mine generally consists of rock strata, wherein the strata vary considerably in their strength and resistance to collapse when their natural underlying support is removed by mining. It has long been known that such a mine roof can be considerably strengthened by bolting or pinning.

Bolting is generally accomplished by drilling into the overhead strata and inserting a metal bolt carrying a bearing plate. The bearing plate may comprise one or more large metal washers, pieces of wood, metal, or combinations of these to provide a bearing surface between the bolt head and the supported rock. The bolt preferably extends well into a strong stratum and is held securely by one of several means, such as by splitting and expanding its end with a wedge when the bolt is forced into the hole by mechanical type anchors or by cementing the bolt in place by the use of quick setting polymerizable resins or cement.

These methods provide more mine area for the moving of men and equipment, and offer many advantages over the earlier methods of timbered supports. They permit the mining of pillars of valuable material which might otherwise be left to serve as structural support.

More recently, considerably success has been achieved by forcing metal pins into the rock under high pressure, generally developed by hydraulic means. This, and related techniques are receiving special attention in recent years, particularly in view of the Federal Coal Mine Health and Safety Act of 1969 because of the dust control and noise level standards which it contains, for the drilling of the roof of a mine of the insertion of roof bolts is both dusty and noisy. This recently developed method of driving pins into the roof by sheer force is, however, generally confined to the use of relatively short pins, for example, in the order of 24 inches in length or less, whereas it is sometimes advantageous to use pins up to 7 feet in length in order to reach a stratum having the desired strength or to unite into one roof structure, strata extending upward from the roof for several feet.

A pin-set machine which drives the pin into rock by sheer force tends to bend and distort the pins becuase of the very high pressures required. This can place an upper limit on the length of pins that can be employed. Such a machine also tends to shatter the rock about the pin, so that the pin can be extracted from its position with less force than would be required it this local shattering action had been avoided.

Although collapse of the roof of a mine is a major hazard which can be substantially eliminated by roof pinning, this technique can also be used to advantage in the "rib"or sidewall of a mine, for in certain mining operations, as for example, in the mining of natural trona, large slabs sometimes split off the rib. These slabs are dangerous to personnel, as well as disruptive, often damaging machines, or holding up mining operations until a passageqay can be cleared. A pin-set machine having the versatility to drive pins into the rib, as well as into the roof of a mine, would offer advantages over one applicable only to roof pinning operations.

SUMMARY OF THE INVENTION

It has now been found that when a pin is driven into the rock face of an underground mine by simultaneously applying pressure and vibration to the pin at sonic frequencies, the tendency for the pin to bend and the rock surrounding the pin to shatter, is substantially reduced. Furthermore, it has been found that less pressure need be exerted on the pin to obtain penetration equal to that obtainable by a continuously applied force and the time required to drive a pin into the rock is appreciably shortened.

The apparatus of the present invention comprises a hollow cylinder adapted for receiving a pin in its upper open end; a cylindrical driving member, movable within the cylinder, on which the head of the pin rests; vibrating means incorporated in the driving member for inducing vibration in the pin and mechanical means for advancing and retracting the driving member within the cylinder. The pinning is effected by first inserting a metal pin into the open ended cylinder. The cylinder is the positioned substantially perpendicular to the rock surface to be pinned, and pressure is applied to the head of the pin by the driving member to exert longitudinal pressure on the pin, while simultaneously vibrating the pin at sonic frequencies. The pin is thereby driven into the rock face to support it against collapse. The pressure exerted on the pin is applied mechanically either by a hydraulic cylinder or by motor-driven screw means.

BRIEF DESCRIPTION OF THE DRAWINGS

This description is directed to the accompanying drawings wherein like reference characters refers to like parts throughout the several views.

DETAILED DESCRIPTION OF THE INVENTION

Figure 1:
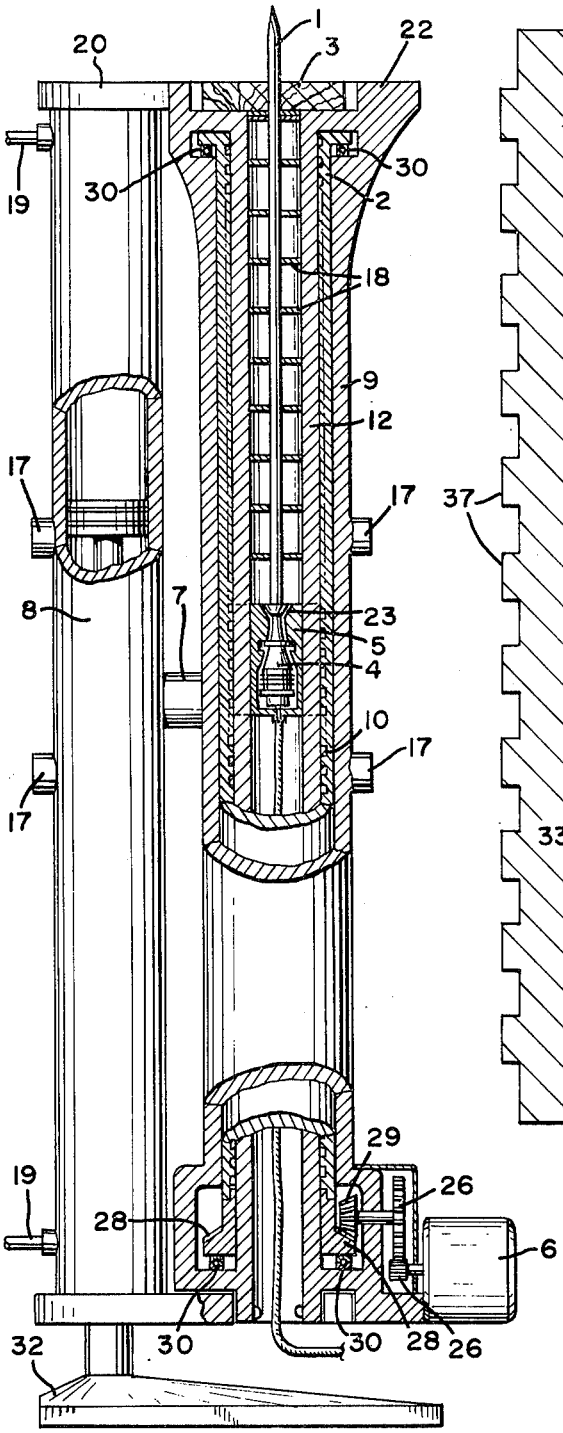
FIG. 1 is a perspective break-away elevation of a preferred embodiment of the present invention. A pin-driving assembly is shown, for driving metal pins in rock faces. This assembly is pivotally attached to a hydraulic cylinder at point 7 for positioning and securing the apparatus at a point where a pin is to be driven. The assembly is broken away to show a pin 1 disposed within a rotatably cylinder 2 with its head resting on a driving member 5 for driving the pin, and containing a vibrating unit 4 for simultaneously inducing vibration in the pin.

Pinning of the rock is effected by first inserting a metal pin having a diameter within the range of ½ to 1½ inches inches and a length of at least 20 inches, head first into the open ended cylinder. The cylinder is positioned against the rock surface to be pinned, and supported in this position to resist the reactive force on the cylinder when pressure is applied to the pin.

In the preferred embodiment, briefly stated, the apparatus for driving metal pins in rock comprises a cylindrical housing having an elongated cylindrical inner surface. A second hollow cylinder journaled within the first for rotation about its longitudinal axis is adapted for receiving a metal pin in its upper end. A spiral female thread extends substantially throughout the full length of this rotatable cylinder. At least one fixed rod extends longitudinally within the rotatable cylinder, along a line adjacent to the inner threaded surface, said rod being connected to the housing at either end of the rotatable cylinder.

A cylindrical driving member is disposed within the rotatable cylinder. The head of pins inserted in the rotatable cylinder rest on the upper surface of this driving member which is adapted for non-rotating motion within the rotatable cylinder. It is restricted to longitudinal motion by at least one longitudinal groove arranged for slideable engagement with a corresponding fixed rod. This driving member has a male thread for engagement with the female thread of the rotating tube, this thread being discontinuous because of the one or more grooves in the surface of the driving member. The driving member also has an internal cavity, and openings at each end in communication therewith. This cavity contains vibrating means. The vibrating device is preferably spaced within the driving member so that a fluid, such as air, can pass into the driving member through the lower opening, flow throughout an annular space between the outer surface of the vibrator and the inner surface of the driving member, and escape through an annulus between the perimeter of the opening in the upper surface of the driving unit and the upper working end of the vibrating device extending into this opening. This flow of fluid, preferably air, passing about the vibrating unit, and escaping through the annulus in the upper surface of the driving member serves to remove heat from the vibrating device and to minimize the danger of rock dust and chips falling into the annulus.

The pin is urged into the rock by the driving member which moves longitudinally as the rotatable cylinder is rotated. Simultaneously with the application of pressure to the pin by the driving means, the vibratory motion of the vibrator within the driving member is induced in the pin by contact, either direct or indirect, of the working end of the vibrating device with the head of the pin, through the opening in the upper surface of the driving member. The rotatable cylinder is rotated by a motor which may be hydraulic, pneumatic or electric.

The entire apparatus as just described is attached to at least one longitudinally extensible member for positioning the apparatus between opposing rock faces with the upper end of the cylinder adjacent to the rock face to be pinned. This attachment of the rock pinning apparatus to the longitudinally extensible member is preferably a pivotal attachment for selective adjustable motion of the pinning apparatus from a first position wherein the pin-driving cylinder and the extensible member are adjacent and parallel, through intermediate positions to a last position wherein the pin-driving cylinder is substantially perpendicular to the extensible member.

Preferably, the entire apparatus is attached to a mobile unit and adjustable with respect thereto for transporting or positioning vertically, horizontally, or in any intermediate position.

There is a great variety of vibrating devices operating at sonic frequencies which can be employed within the driving member. There are, for example, magnetostrictive vibrating means utilizing a magneto-strictive core in an electromagnetic field of fixed frequency; electro-strictive vibrating means utilizing an electrostrictive core in an electric field of fixed frequency, and electromagnetic means employing a magnetically responsive core in physical contact with the head of the pin, and driven by a uniformly fluctuating magnetic field. There are also hydraulic and pneumatic vibrating device which operate at sonic frequencies.

A preferred vibrating device is the so-called sonic motor employing piezo-electric crystals, subjected to an electric current having a frequency between about 1000 and 20,000 cycles per second. Any of these vibrating device are preferably mounted with a spring or other biasing means to press the working end in contact with the head of the pin. In the case of the sonic motors, attachment is preferably made at the node point of no vibration.

With further reference to the drawings for a better understanding of the preferred embodiment of my invention, first consider the apparatus of FIG. 1.

Preferably, the entire apparatus is transported by a mobile unit not shown. Attachment to the mobile unit may be made at swivel points 17 by which arrangement of the apparatus can be transported or positioned in a horizontal or vertical position or at any angle in between. Such mobile units with adjustable supporting frame, generally hydraulically operated, are commercially available as for example from the Joy Manufacturing Company.

Where the rock face to be pinned is a mine roof, pin 1 is lowered into rotatable cylinder 2, preferably when the assembly is in substantially a horizontal position. Washers 18 are preferably pre-spaced along the pin. They fit about the pin friction tight, yet are slideable when moderate force is applied. The washers are sized to be slideably guided by the fixed parallel rods 12 within the rotatable cylinder. For this reason rods 12 should preferably be three or more in number, and preferably spaced equidistantly to minimize the danger of bending the pin when pressure is applied. In the illustration, a wooden bearing plate 3 is used.

The pin-driving assembly carrying a pin and bearing plate is erected so as to be vertical to the rock surface to be pinned, and hydraulic fluid is permitted to enter hydraulic cylinder 8 through the upper inlet 19 at a pressure sufficient to firmly position the pressure plates 20 and 22 against the rock surface of the mine roof and foot plate 32 against the mine floor. Generally, with a cylinder having an inside diameter of 6 inches, a pressure between 1000 and 2000 pounds per square inch (psi) is adequate.

Pressure is applied to pin 1 by driving member 5, which has a conical receptical 23 (FIG. 2) for receiving and centering the head of the pin. The upward pressure on driving member 5 is mechanically produced by the rotation of cylinder 2. The driving member cannot rotate. It has longitudinal grooves which slideably engage fixed rods 12, hence rotation of the driving member is prevented. Consequently, because the spiral female threads 10 of cylinder 2 (FIG. 2) engage the male threads 37 of the driving member, rotation of cylinder 2 moves the driving member longitudinally at a mechanical advantage, determined by the pitch of the threads.

There are many different ways in which cylinder 2 may be rotated. It may be rotated by a hydraulic motor connected directly to the rotatable cylinder, or it may be rotated in either direction by a hydraulic, pneumatic, electric or other type of motor geared to the rotatable cylinder. In the illustration an electric motor 6 acting through reduction gears 26, bevel ring gear 28 and bevel gear 29, drives the rotatable cylinder 2. The rotatable cylinder turns on upper and lower bearings 30 and the direction of the movement of the driving member 5 is determined by the direction or rotation of motor 6.

Simultaneously with the application of pressure to the pin, power is applied to the vibrating member 4 in the cavity within the advancing driving member, and the vibratory motion produced is transmitted to the pin by contact of the head of the pin with the working end 36 of the vibrating unit. In the illustration a piezo-electric sonic motor is used.

Figure 2:
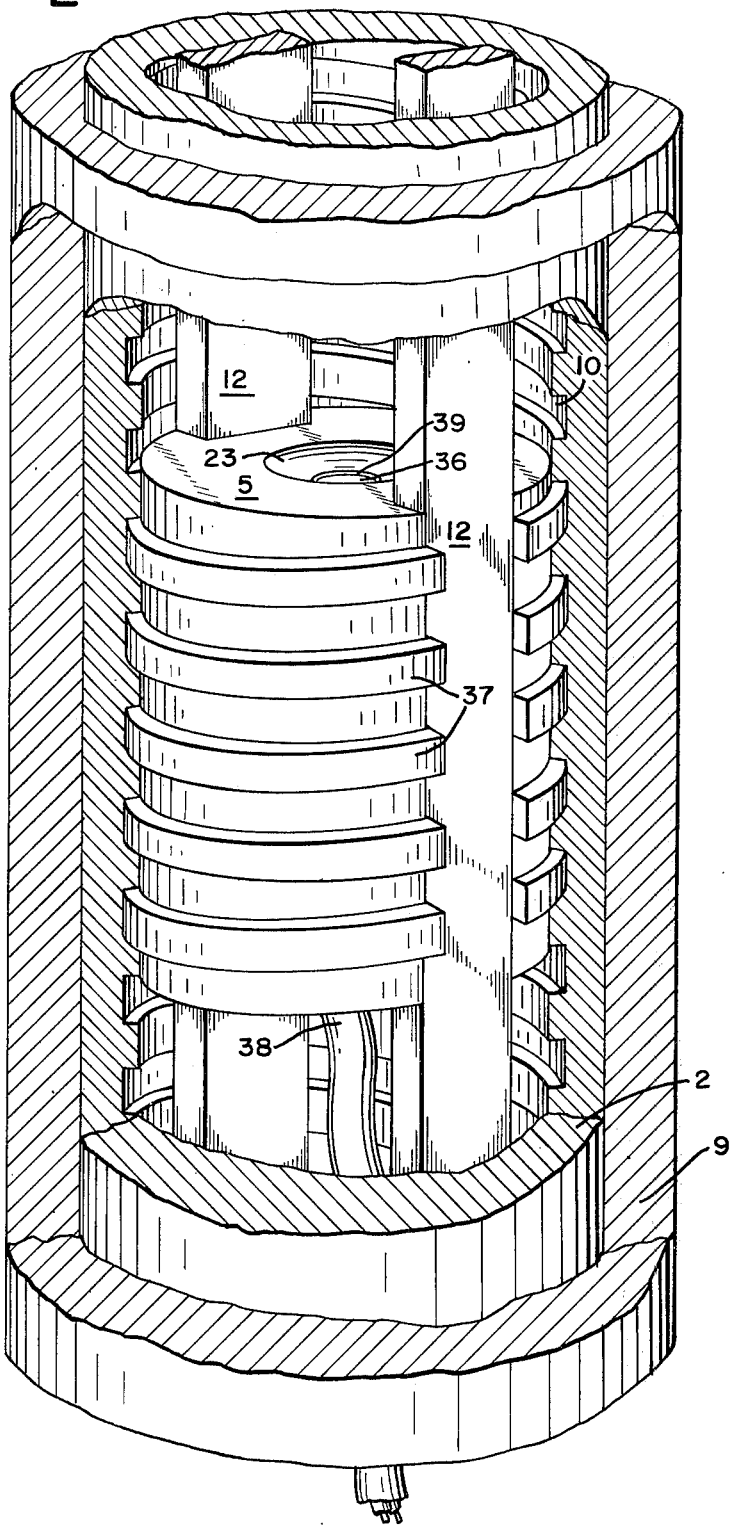
FIG. 2 is a perspective break-away drawing of a section of the pin-driving assembly, including the driving member 5, to illustrate the arrangement which permits the driving member to be moved longitudinally within the rotating cylinder 2 while prevented from rotating by fixed rods 12, two of which are shown. Longitudinal grooves in the driving member slideably engage the rods. A conical recess 23 for receiving the head of a metal pin and conduit 38 for carrying power and cooling fluid to the vibrating unit are also shown.

FIG. 2 is an enlarged break-away perspective view of a section of the pin-driving assembly of FIG. 1. It will be noted that driving member 5 is slideably arranged with respect to fixed rods 12 of which two are shown, and that because of this arrangement no rotation of the driving member is possible.

It will also be noted that because of the engagement of the outer threads 37 of the driving member, with the inner threads 10 of the rotatable cylinder 2, no longitudinal motion is possible except when such longitudinal motion is brought about through rotation of cylinder 2. Whe cylinder 2 is rotated within the encompassing housing 9, driving member 5 moves upward or downward depending on the direction of rotation of cylinder 2. Furthermore, it moves with considerable mechanical advantage, the amount depending on the pitch of the threads and the reduction gearing, it any, designed into the power source employed in rotating cylinder 2 (motor 6 of FIG. 1).

When a pin is inserted, head first into the rotating cylinder between fixed rods 12, the head of the pin slips into conical recess 23 in the head of the driving member. The friction-tight washers spaced throughout the length of the pin slideably slip between the fixed rods to provide lateral support at several points along the length of the pin. Although one rod is sufficient to prevent the driving member from rotating, and only two are shown in FIG. 2 in the interests of clarity, it is clear that at least three should be used to provide stable support to the washers on the pin, and therefore to the pin itself. Preferably, three or four such fixed rods are employed. The tapered head of a pin rests in conical recess 23 with the conical side walls providing the upward force to the pin. The head of the pin is also contacted by the working end 36 of the vibrating member. If desired, particularly to minimize distortion of the working end of the vibrating member with use and to minimize the opportunity for the pin to influence the vibration rate or frequency of the vibrating member, a solid floating member or detached spacer 25 (FIG. 3) may be interposed between the pin head and the working end of the vibrating member. If a spacer is used, preferably it is fabricated of metal.

Power to the vibrating unit is supplied through conduit 38 and this conduit is preferably also used for introduction of a fluid such as air, which flows about the vibrating unit to remove heat and escapes through annulus 39 to prevent rock chips and dust from entering the cavity.

Figure 3:
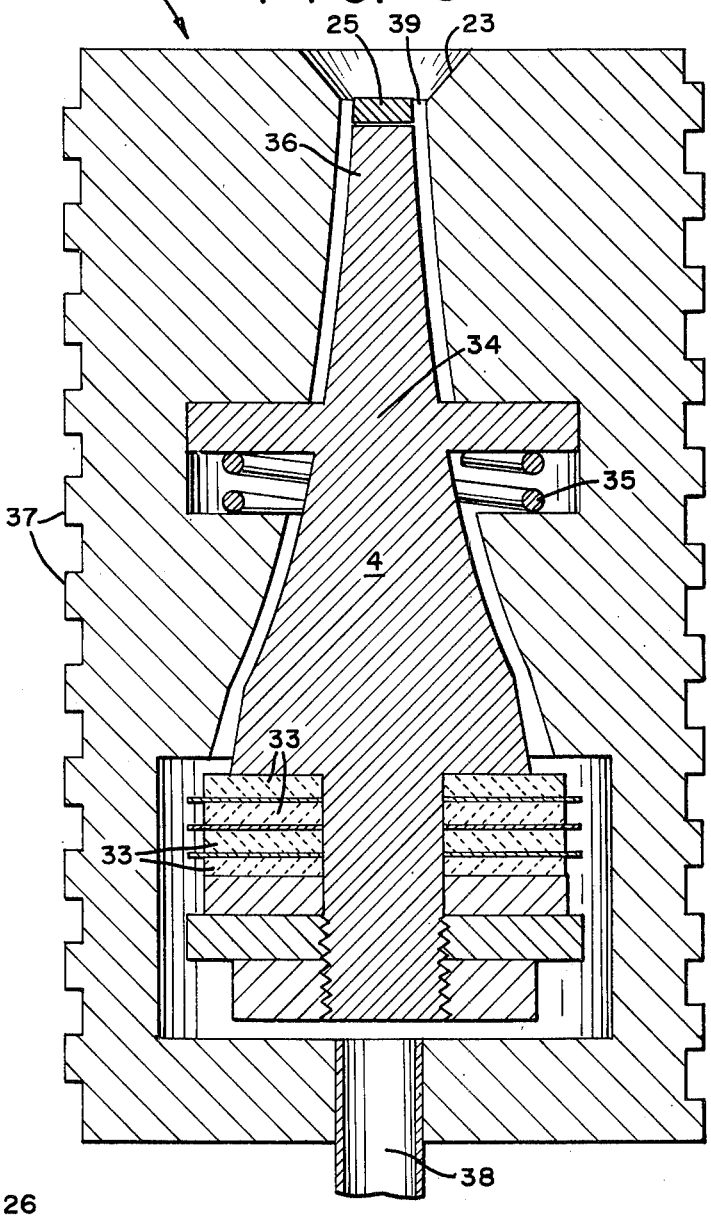
FIG. 3 is a cross-section of the hollow driving member 5 showing an electrically activated vibrating device 4 disposed within the cavity, and biased by means of spring 35 into a position to bring its working tip into contact with the head of a pin placed in receptical 23.

FIG. 3 is a cross-section of driving member 5, illustrating the position of a vibrating unit 4 within the hollow driving member. In this illustration the vibrating unit is a piezoelectric sonic motor, supported within the driving member at its node point of no vibration 34. Its working end 36 extends into the conical recess for contact with the head of a pin situated therein, and is biased to this position by spring 35.

Figure 4:
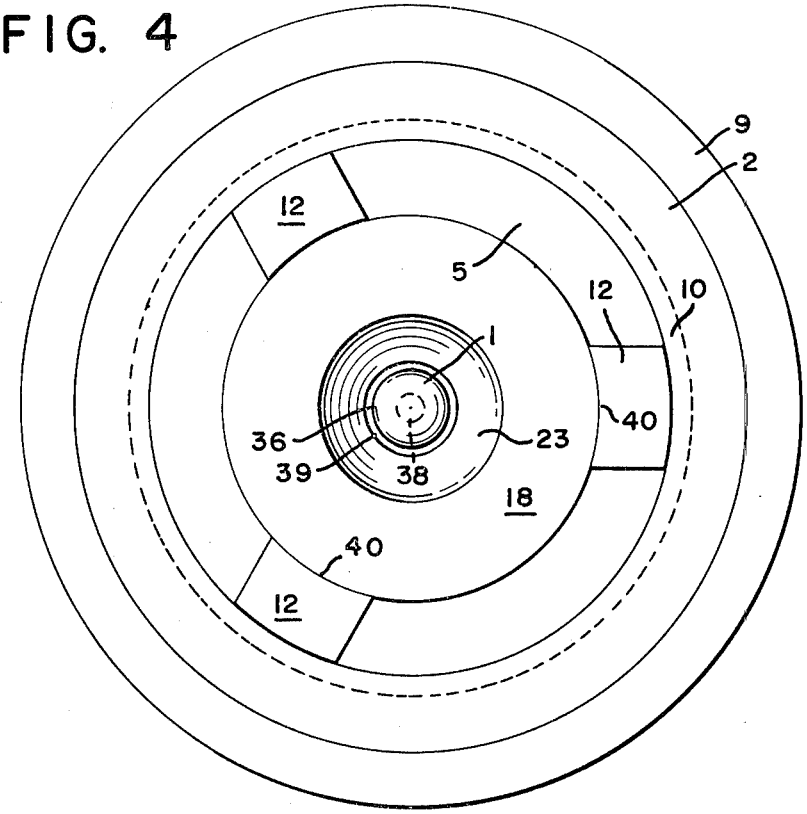
FIG. 4 is a transverse plan view of a pin-driving assembly similar to that of FIG. 2, but differing in that it has three equispaced fixed rods 12 rather than two.

FIG. 4 is a transverse plan view of a pin driving assembly similar to that of FIG. 2, but differing in that it has three equispaced fixed rods 12, rather than two. Numeral 38 indicates the concentric position of the conduit bringing power and if desired, cooling fluid such as air to the vibrating unit within driving member 5. The working tip of the vibrating unit is represented by circle 36, with the annulus 39 for the escape of air. Concentric area 23 represents the sloping sides of the recess for receiving the head of a pin, whereas circle 1 represents the diameter of the pin itself. The concentric area 18, and that extending inwardly to circle 1, together represents the washers about the pin for supplying lateral support. It will be noted that they, in turn, receive lateral support at their perimeter from fixed rods 12 of which three are shown. It can be seen that good support would be difficult to obtain with fewer fixed rods than three, although possible, if two relatively wide rods are used with concave cylindrical surfaces at 40. Concentric space 10 represents the engaged male and female threads, therefore being jointly a portion of both the rotating cylinder 2, and the driving member 5. Finally, outer concentric area 9 represents the housing with its inner cylindrical surface adjacent to the outer cylindrical surface of the rotating cylinder 2.

Figure 5:
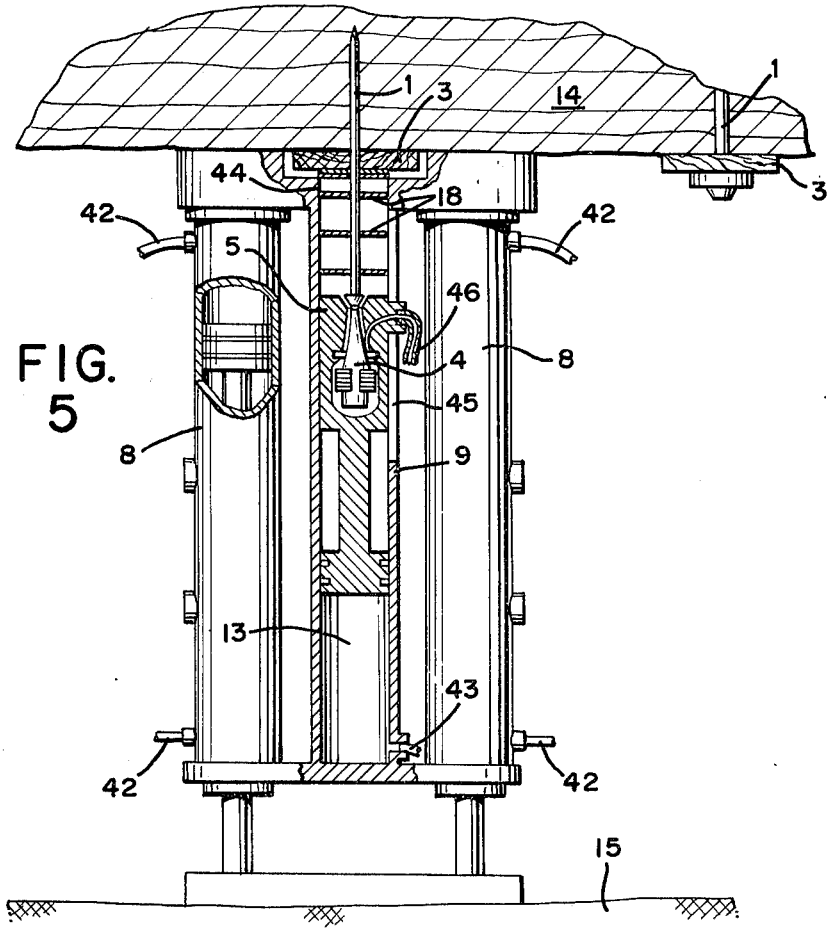
FIG. 5 is a break-away perspective drawing of another embodiment of the present invention with the pin-driving assembly disposed between two hydraulic cylinders 8. Pressure is applied to the pin by a third hydraulic cylinder 13. The apparatus is shown as employed in pinning a mine roof 14 while pressing against mine floor 15.

FIG. 5 is a break-away perspective drawing of another embodiment of the present invention with the pin-driving assembly disposed between two hydraulic cylinders 3. Pressure is applied to the pin by a third hydraulic cylinder 13. The apparatus is shown as engaged in pinning a mine roof 14 while positioned by pressure applied to the roof 14 and floor 15. As shown, this design will only accommodate relatively short pins, but may be modified to take long pins by using a telescoping hydraulic jack having at least three sections, or alternately a telescoping screw-jack having at least three sections, in place of the single hydraulic cylinder 13.

Figure 6:
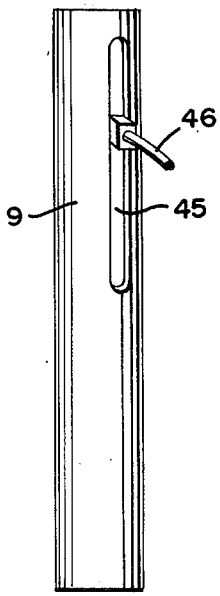
FIG. 6 is a perspective view of hydraulic cylinder 13, turned sufficiently to show slot 45 through which power and cooling fluid can be supplied to the sonic vibrating device without interfering with the longitudinal motion of the driving member 5.

After the supporting hydraulic cylinders 8 are employed to position the pin-driving cylinder 9 by admitting hydraulic fluid at inlets 42 at a pressure of about 1000 psi, hydraulic fluid is applied to cylinder 13 through inlet 43. Simultaneously, vibrating unit 4 induces vibration in the pin, increasing the ease with which the pin is driven into the rock strata. In this device, the washers encircling the pin slideably contact the cylinder wall 44, and the illustration shown how the washers slide along the pin as it enters the rock to accumulate between the bearing 3 and the head of the pin. A pin completely driven is also shown. Usually, pins are driven into the rock in a pattern with the pins about 4 feet apart. The piston is retracted in the cylinder by pumping out the hydraulic fluid at 43, by reversing the positive acting pump or using an auxiliary exhaust pump. In the embodiment of FIG. 5, the power and cooling fluid enters the cavity in the driving member 5 through conduit 45 which rides with the driving member in slot 45, as shown to better advantage in the partially turned section of the pin-driving cylinder of FIG. 6. Without the benefit of the vibrating unit, and using a cylinder having an inside diameter of 6½ inches, a pressure of 6000 psi or more may be required. When a vibrator is used the pin may be driven rapidly at low pressures, although the actual pressure required, which may be relatively slight when a 15 horsepower sonic motor having a frequency of 10,000 cycles per second is used, will vary depending on the type of vibrator used, and the power and frequency of the vibrator.

Many different types of sonic vibrators may be employed, as for example, those using a magneto-strictive core in an electro-magnetic field, or an electro-strictive core in a high frequency electric field. A simple electromagnetic vibrator may be used or one of the many types of hydraulic or pneumatically operated vibrating units, most of which are generally self-activating.

A type of vibrating unit which is preferred and which is illustrated in our FIGS. 1, 3 and 5 is the piezo-electric sonic motor of the type developed at the Sonic Power Laboratory of Ohio State University. A sonic motor of this type having an output of about 15 HP is particularly effective. Briefly, such a motor consists of a solid 20 inch machined steel catenoidal-shaped horn which tapers to a narrow working tip. Extending concentrically from the wide end of the horn is a cylindrical shaft about 6½ inches long and 1½ inches in diameter, threaded at the far end. In machining the horn, a substantial flange is left partway along its length at the point which will be the "null point", or point of no vibration for the finished sonic motor. This flange is eventually used for mounting the motor so that no vibration will be transferred to the support as long as the motor is free to vibrate at its designed frequency. Four piezo-electric crystals of lead zirconate titanate in the form of rings about 3½ inches in diameter, ½ inch thick and protected by rubber are separated by metal rings as electrodes, and the assembly slipped on the shaft, and clamped by means of a large nut screwed on the threaded end of the shaft. Such piezo-electric crystals are commercially available. Proper electrical connections and insulation are provided so that the crystals may be activated by a high frequency current having an emf of about 2,600 volts. Power is preferably supplied by a 10,000 cycle electric generator of the induction heating type, which is stepped up to the required voltage by meand of a suitable step-up transformer.

Such motors weight about 22 pounds and have an efficiency in the order of 97%. The catenoidal-shaped horn amplifies the vibrations of the piezo-electric crystals to give a displacement at the tip of about 0.0035 inch at 10,000 cycles per second. A total delivered power of 11 kilowatts or about 15 horsepower is obtained. The sound emitted by the sonic motor is more than an octave above the highest note on the piano.

As has been pointed out, the tip of the sonic motor is not attached to the pin, but is either in direct contact with it when at rest, or in indirect contact through a separate floating piece of metal or other solid placed between the pin head and the working tip. It the pin were rigidly connected with the working tip, the frequency of the motor could be forced out of step with its power supply, thereby lessening its effectiveness.

The piezo-electric sonic motor could be powered by a variable frequency power source as well as by one having a constant frequency but such units are costly and not necessary. They do, however, permit varying the frequency to obtain an acoustical relationship with the natural resonance of the pin. This resonance varies with the depth of the pin in the rock, and with the nature, mass, and position of its appurtenances such as washers and bearing plate.

As has been pointed out, a piezo-electric sonic motor of the design and power described has a displacement or stroke of about 0.0035 inch at a frequency of 10,000 cycles. If the frequency is increased by the use of a variable frequency power source, the displacement will correspondingly decrease. Whereas it would be possible to employ ultrasonic frequencies over 20,000 cycles per second with some effectiveness, and at the same time eliminate sensible sound, the displacement would become extremely minute and possibly become destructive to equipment. Sonic frequencies are therefore preferred, ranging from about 1000 to 20,000 cycles per second.

Since changes may be made in the apparatus as disclosed and in the method of driving pins into rock without departing from the scope of my invention, it is intended that all matter contained in the above description shall be interpreted as illustrative and not in a limiting sense.

I claim:

1. An apparatus for driving metal pins into a rock face in an underground mine, comprising:

a. a housing with an inner cylindrical surface;

b. a hollow cylinder adapted for receiving a pin in its upper open end, said cylinder being concentrically disposed for rotation within the housing, with its outer surface contiguous with the inner surface of the housing, said hollow cylinder having a female thread extending substantially throughout its full length;

c. means for rotating the rotatable cylinder;

d. a movable driving member disposed within the rotatable cylinder on which the head of the pin rests, said member having a male thread for cooperative engagement with the female thread of the rotatable cylinder;

e. vibrating means incorporated into the movable driving member; and f. means for preventing rotation of the driving means.

2. The apparatus of claim 1 wherein a flexible conduit for conducting power and cooling fluid to the vibrating means incorporated in the driving member enters the driving member through an opening in the side, a longitudinal slot being provided in the upper part of the cylinder, coincident with the opening in the driving member in all of its positions, for entry of the conduit, said slot ending in its downward extension above the point reached by the slideably hydraulic piston integrated with the driving means.

3. An apparatus for driving metal pins into a rock face in an underground mine, comprising:

a. a cylindrical housing having an elongated cylindrical inner surface;

b. a second hollow cylinder journaled within the first for rotation about its longitudinal axis, said second cylinder adapted for receiving a metal pin in its upper end;

c. a spiral female thread extending substantially throughout the full length of the second cylinder;

d. a fixed rod extending longitudinally within the second cylinder along a line substantially adjacent to the inner cylindrical threaded surface, said rod being connected to the housing at either end of the second cylinder;

e. a substantially cylindrical driving member disposed within the second cylinder, on which the head of the metal pin rests, said driving member being adapted for longitudinal non-rotating motion within the second cylinder and having a longitudinal groove along one side for slideable cooperation with the fixed rod;

f. said driving member having a discontinuous male thread for cooperative engagement with the female thread of the second cylinder;

g. said driving member having a cavity within and openings at each end in communication therewith;

h. said cavity containing vibrating means for inducing a longitudinal vibrating motion to the metal pin placed within the second cylinder, said vibratory motion being transmitted through the opening in the upper end of the driving member;

i. means for rotating the second cylinder to thereby transport the driving member longitudinally within; and j. means for positioning the upper end of the housing against a rock surface.

4. The apparatus of claim 3 wherein the fixed rod comprises a plurality of rods for cooperation with a plurality of corresponding longitudinal grooves along the cylindrical sides of the driving member, said rods being sized so that their inner surfaces serve as guides and lateral supports for pins with support washers inserted into the rotating cylinder adapted for receiving them.

5. The apparatus of claim 3 wherein conducting means are provided, entering the rotating tube from its lower end, and entering the opening in the driving means, to transmit power to the vibrating means within.

6. The apparatus of claim 5 wherein conduit is provided containing fluid which flows to the driving means, to conduct heat away from the vibrating unit, and for escape through the opening in the upper end of the driving means.

7. The apparatus of claim 5 wherein the opening in the upper surface of the driving member is conical, flaring upwardly, to provide a receptacle for the head of a pin inserted into the rotating cylinder and to provide contact surface for forcing the pin into rock during the rock pinning operation, said vibrating means having a member extending into the bottom of the conical opening for inducing vibration to the pin, the head of said pin being disposed in the conical receptical, said opening being reduced to an annular space about the member of the vibrating means extending therein.

8. The apparatus of claim 7 wherein the fluid is air, which escapes through the annular space to minimize the danger of rock dust and chips entering said annular space.

* * * * *